US010524050B2

(12) United States Patent
terMeulen et al.

(10) Patent No.: US 10,524,050 B2
(45) **Date of Patent: *Dec. 31, 2019**

(54) DUAL-USE BILATERAL MICROPHONE ARRAY

(71) Applicant: Bose Corporation, Framingham, MA (US)

(72) Inventors: Ryan terMeulen, Watertown, MA (US); Andrew Jackson Stockton, X, Miami, FL (US)

(73) Assignee: Bose Corporation, Framingham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/272,013

(22) Filed: Feb. 11, 2019

(65) Prior Publication Data

US 2019/0174228 A1 Jun. 6, 2019

Related U.S. Application Data

(63) Continuation of application No. 15/910,881, filed on Mar. 2, 2018, now Pat. No. 10,250,977, which is a (Continued)

(51) Int. Cl.
*H04R 3/00* (2006.01)
*H04R 1/10* (2006.01)

(Continued)

(52) U.S. Cl.
CPC ..... *H04R 3/005* (2013.01); *G10L 21/028* (2013.01); *H04R 1/1083* (2013.01); *H04R 1/406* (2013.01); *H04R 5/033* (2013.01); *G10L 2021/02166* (2013.01); *H04R 1/1016* (2013.01); *H04R 1/1075* (2013.01); *H04R 2201/107* (2013.01);

(Continued)

(58) Field of Classification Search
CPC ..... H04R 1/10; H04R 1/406; H04R 1/1016; H04R 1/1075; H04R 1/1083; H04R 3/00; H04R 3/005; H04R 3/04; H04R 3/12; H04R 5/033; H04R 2400/01; H04R 2410/07; H04R 2430/20; H04R 2430/21; H04R 25/48; H04R 25/405; H04R 25/407;

(Continued)

(56) References Cited

U.S. PATENT DOCUMENTS 8,184,822 B2 * 5/2012 Carreras ..... G10K 11/178 381/71.6
8,620,650 B2 * 12/2013 Walters ..... G10L 21/0208 381/98

(Continued)

*Primary Examiner* — Thang V Tran
(74) *Attorney, Agent, or Firm* — Bose Corporation

(57) ABSTRACT

A pair of earphones have microphone arrays each including a front microphone and a rear microphone. A processor uses a first set of filters to combine the four microphone signals to generate a far-field signal that is more sensitive to sounds originating a short distance away from the earphones than to sounds close to the apparatus, and provides the far-field signal to the speakers for output. The processor also uses a second set of filters to combine the four microphone signals to generate a near-field signal that is more sensitive to voice signals from a person wearing the earphones than to sounds originating away from the earphones, and provides the near-field signal to a communication system.

15 Claims, 10 Drawing Sheets

Related U.S. Application Data continuation of application No. 15/347,419, filed on Nov. 9, 2016, now Pat. No. 9,930,447.

(51) Int. Cl.

| | |
|---|---|
| ***G10L 21/028*** | (2013.01) |
| ***H04R 1/40*** | (2006.01) |
| ***H04R 5/033*** | (2006.01) |
| *G10L 21/0216* | (2013.01) |

(52) U.S. Cl.

CPC ..... *H04R 2410/07* (2013.01); *H04R 2430/21* (2013.01)

(58) Field of Classification Search

CPC ..... H04R 2201/107; G10L 21/028; G10L 21/0208; G10L 2021/02166

See application file for complete search history.

(56) References Cited

U.S. PATENT DOCUMENTS 8,798,283 B2 * 8/2014 Gauger, Jr. ..... H04R 3/002 381/71.6
9,020,160 B2 * 4/2015 Gauger, Jr. ..... H04R 1/1083 381/71.6
9,190,043 B2 * 11/2015 Krisch ..... G10K 11/002
9,282,392 B2 * 3/2016 Ushakov ..... H04R 1/1033
9,843,861 B1 * 12/2017 Termeulen ..... H04R 3/005
9,930,447 B1 * 3/2018 Termeulen ..... H04R 3/005
10,250,977 B2 * 4/2019 terMeulen ..... H04R 3/005
2006/0262946 A1 * 11/2006 Yang ..... H04R 5/027 381/175
2009/0147966 A1 * 6/2009 McIntosh ..... H04R 3/005 381/71.11
2009/0209290 A1 * 8/2009 Chen ..... G10L 21/0208 455/563
2010/0046776 A1 * 2/2010 Fischer ..... H04R 25/407 381/313
2010/0280824 A1 * 11/2010 Petit ..... G10L 21/0208 704/214
2012/0008807 A1 * 1/2012 Gran ..... H04R 25/407 381/313
2012/0020485 A1 * 1/2012 Visser ..... H04R 3/005 381/57
2014/0093093 A1 * 4/2014 Dusan ..... H04R 3/005 381/74
2015/0078597 A1 * 3/2015 Andrea ..... H04R 3/005 381/309
2015/0170632 A1 * 6/2015 Olsson ..... G10K 11/175 381/71.6
2015/0230026 A1 * 8/2015 Eichfeld ..... H04R 5/027 381/26
2016/0267899 A1 * 9/2016 Gauger, Jr. ..... G10K 11/175

* cited by examiner

DUAL-USE BILATERAL MICROPHONE ARRAY

CLAIM TO PRIORITY AND RELATED APPLICATIONS

This application is a continuation of, and claims priority to, U.S. patent application Ser. No. 15/910,881, filed Mar. 2, 2018, now U.S. patent 10,250,977, which is a continuation of, and claims priority to, U.S. patent application Ser. No. 15/347,419, filed Nov. 9, 2016, now U.S. Pat. No. 9,930,447, the entire contents of which are incorporated by reference. This application is also related to U.S. Pat. No. 9,843,861, grated Dec. 12, 2017, and U.S. Pat. No. 10,158,941, granted Dec. 18, 2018, both titled Controlling Wind Noise in a Bilateral Microphone Array, the entire contents of which are incorporated here by reference.

BACKGROUND

This disclosure relates to a dual-use bilateral microphone array, and to controlling wind noise in such an array.

Hearing aids often include two microphones, which are used to form a two-microphone beam-forming array that potentially optimizes the detection of sound in a particular direction, typically the direction the user is looking. Each hearing aid (i.e., one for each ear) has such an array, operating independently of the other. Earpieces meant for communications, such as Bluetooth® headphones, also often include two-microphone arrays, aimed not at the far-field, but at the user's own mouth, to detect the user's voice for transmission to a far-end conversation partner. Such arrays are typically provided only on a single earpiece, even in devices having two earpieces.

The use of four microphones total, two in each ear, is described in U.S. Patent application publication 2015/0230026, incorporated here by reference. That disclosure provides improved performance over using a separate pair of microphones for each ear, in the context of detecting the voice of another person, for assisting the user in hearing and conversing with the other person in a noisy environment.

SUMMARY

In general, in one aspect, a first earphone has a first microphone array including a first front microphone, providing a first front microphone signal, and a first rear microphone, providing a first rear microphone signal, and a first speaker. A second earphone has a second microphone array, including a second front microphone, providing a second front microphone signal, and a second rear microphone, providing a second rear microphone signal, and a second speaker. A processor receives the first front microphone signal, first rear microphone signal, second front microphone signal, and second rear microphone signal, uses a first set of filters to combine the four microphone signals to generate a far-field signal that is more sensitive to sounds originating a short distance away from the apparatus than to sounds close to the apparatus, and provides the far-field signal to the speakers for output. The processor also uses a second set of filters to combine the four microphone signals to generate a near-field signal that is more sensitive to voice signals from a person wearing the earphones than to sounds originating away from the apparatus, and provides the near-field signal to a communication system.

Implementations may include one or more of the following, in any combination. The first microphone array and second microphone array may be physically arranged to optimize detection of sounds a short distance away from the apparatus. The two front microphones may face forward when the earphones are worn, the two rear microphones face rearward when the earphones are worn, and a line through the microphones of the first array intersects a line through the microphones of the second array at a position about two meters ahead of the earphones when worn by a typical adult human. The processor may use a third set of filters, different from the second set of filters, to combine the four microphone signals to generate a second near-field signal that is more sensitive to voice signals from the person wearing the earphones than to sounds originating away from the apparatus, and provide the second near-field signal to the speakers for output. Providing the far-field signal to the speakers may include filtering the far-field signal according to a set of user preferences associated with an individual user. The processor may be made up of several sub-processors, and the filtering of the far-field signal according to the set of user preferences may be performed by a separate sub-processor from the sub-processor which applies first set of filters to combine the four microphone signals to generate the far-field signal.

The processor may generate the far-field signal and provide the far-field signal to the speakers by using a third set of filters, different from the first set of filters, to combine the four microphone signals to generate a second far-field signal that is more sensitive to sounds a short distance away from the apparatus than to sounds close to the apparatus, providing the first far-field signal to the first speaker, and providing the second far-field signal to the second speaker. Providing the first far-field signal and the second far-field signals to the respective first and second speakers may include filtering the first far-field signal according to a set of user preferences associated with a first ear of an individual user, and filtering the second far-field signal according to a set of user preferences associated with a second ear of an individual user. The processor may generate the near-field signal by summing the signals corresponding to the first front microphone and the second front microphone to form an combined front microphone signal, summing the signals corresponding to the first rear microphone and the second rear microphone to form a combined rear microphone signal, filtering the combined front microphone signal to form a filtered combined front microphone signal, filtering the combined rear microphone signal to form a filtered combined rear microphone signal, and combining the filtered combined front microphone signal and the filtered combined rear microphone signal to form a directional microphone signal, the near-field signal including the directional microphone signal. The processor may operate the first and second sets of filters simultaneously.

In general, in one aspect, a first earphone has a first microphone array including a first front microphone, providing a first front microphone signal, and a first rear microphone, providing a first rear microphone signal, and a first speaker. A second earphone has a second microphone array, including a second front microphone, providing a second front microphone signal, and a second rear microphone, providing a second rear microphone signal, and a second speaker. A processor receives the first front microphone signal, first rear microphone signal, second front microphone signal, and second rear microphone signal. The first microphone array and the second microphone array are physically arranged to have greater sensitivity to sounds a short distance away from the apparatus than to sounds close to the apparatus. The processor uses a first set of filters to combine the four microphone signals to generate a near-field signal that is more sensitive to voice signals from a person wearing the earphones than to sounds originating away from the apparatus, and provides the near-field signal to a communication system for output.

In general, in one aspect, a first earphone has a first microphone array providing a first plurality of microphone signals, and a first speaker. A second earphone has a second microphone array providing a second plurality of microphone signals, and a second speaker. A processor receives the first plurality of microphone signals and second plurality of microphone signals, and applies a first set of filters to a subset of the plurality of microphone signals from each of the first microphone array and the second microphone array, the first set of filters inverting the signals below a cutoff frequency, and provides the first-filtered signals and the remainder of the microphone signals from each of the first microphone array and the second microphone array to a second set of filters. The processor also uses the second set of filters to combine the microphone signals to generate a far-field signal that is more sensitive to sounds originating a short distance away from the apparatus than to sounds close to the apparatus above the cutoff frequency, and omnidirectional below the cutoff frequency, determines a level of wind noise present in the microphone signals, adjusts the cutoff frequency as a function of the determined level of wind noise, and provides the far-field signal to the speakers for output.

Implementations may include one or more of the following, in any combination. The processor may, after generating the far-field signal in the second set of filters, apply gain to the output of the filters below a second cutoff frequency which is a function of the first cutoff frequency. The processor may, after generating the far-field signal in the first set of filters, apply a high-pass filter to the output of the filters. The processor may determine a total low-frequency energy present in the microphone signals, and upon determining that the total sound level is below a first threshold, and the level of wind noise is below a second threshold, increase the cutoff frequency of the first set of filters. Generating the far-field signal may include determining a total low-frequency energy present in the microphone signals, computing a sum of the microphone signals, computing a difference of the microphone signals, comparing the sum of the microphone signals to the difference of the microphone signals, and determining the cutoff frequency based on the results of the comparison. Computing the difference of the microphone signals may include computing a first difference of microphone signals in the first plurality of microphone signals, computing a second difference of microphone signals in the second plurality of microphone signals, and computing a difference of the first difference and the second difference as the difference of the microphone signals.

In general, in one aspect, a first earphone has a first microphone array providing a first plurality of microphone signals, and a first speaker. A second earphone has a second microphone array providing a second plurality of microphone signals, and a second speaker. A processor receives the first plurality of microphone signals and second plurality of microphone signals, and uses a first set of filters to combine the microphone signals to generate a far-field signal that is more sensitive to sounds originating a short distance away from the apparatus than to sounds close to the apparatus above a cutoff frequency, and omnidirectional below the cutoff frequency, determines a level of wind noise present in the microphone signals, adjusts the cutoff frequency as a function of the determined level of wind noise, and provides the far-field signal to the speakers for output. The processor also uses a second set of filters to combine the microphone signals to generate a near-field signal that is more sensitive to voice signals from a person wearing the earphones than to sounds originating away from the apparatus, combines the microphone signals to generate an omnidirectional signal, combines the near-field signal and the omnidirectional signal using a weighted sum, the weight being a function of the determined level of wind noise to generate a communication signal, and provides the communication signal to a communication system.

Implementations may include one or more of the following, in any combination. The processor may determine the level of wind noise for adjusting the cutoff frequency based on a comparison of a sum of the microphone signals to a difference of the microphone signals, and determine the level of wind noise for adjusting the weight applied to the near field signal in the communication signal based on a comparison of the near field signal to the omnidirectional signal. Generating the far-field signal may include applying an all-pass filter to a subset of the plurality of microphone signals from each of the first microphone array and the second microphone array, the all-pass filter inverting the signals below the cutoff frequency, and providing the all-pass-filtered signals and the remainder of the microphone signals from each of the first microphone array and the second microphone array to the first set of filters. Generating the near-field signal and omnidirectional signal may include applying a third set of filters to a first subset of the plurality of microphone signals from each of the first microphone array and the second microphone array, applying a fourth set of filters to a second subset of the plurality of microphone signals from each of the first microphone array and the second microphone array, combining the filtered first subset with the filtered second subset to generate the near-field signal, and summing the first subset and the second subset to generate the omnidirectional signal. Generating the near-field signal and omnidirectional signal may also include summing the first subset and providing the summed first subset to the third set of filters, summing the second subset and providing the summed second subset to the fourth set of filters, summing the summed first subset and the second summed subset to generate the omnidirectional signal. The processor may be made up of several sub-processors, and the summing of the first and second subsets may be performed by a separate sub-processor from the applying of the third and fourth filters and combining of the filtered subsets.

In general, in one aspect, a first earphone has a first microphone, providing a first microphone signal, and a first speaker. A second earphone has a second microphone, providing a second microphone signal, and a second speaker. A processor receives the first microphone signal and second microphone signal, and uses a first set of filters to combine the microphone signals to generate an output signal. The processor generates the output signal by applying a low-pass filter to each of the first microphone signal an the second microphone signal, comparing the low-pass-filtered first microphone signal to the low-pass-filtered second microphone signal and determining whether one may have a greater noise content than the other, and upon determining that the first microphone signal has greater noise content than the second microphone signal, decreasing an amount of gain applied to the first microphone signal below a cutoff frequency in the first set of filters. Upon subsequently determining that the first microphone signal no longer has greater noise content than the second microphone signal, the processor restores the amount of gain applied to the first microphone signal in the first set of filters.

Implementations may include one or more of the following, in any combination. The processor may, upon determining that the first microphone signal has greater noise content than the second microphone signal, decrease an amount of gain applied to the first microphone signal below the cutoff frequency in a second set of filters, and upon subsequently determining that the first omnidirectional signal no longer has greater noise content than the second omnidirectional signal, restore the amount of gain applied to the first microphone signal in the second set of filters, and use the second set of filters to combine the microphone signals to generate a second output signal, where the first output signal is provided to the speakers and the second output signal is provided to a communication system. The first set of filters may produce a far-field array signal, and the second set of filters may produce a near-field array signal. The first earphone may include a third microphone, providing a third microphone signal, the second earphone may include a fourth microphone, providing a fourth microphone signal, and the processor may compare the first microphone signal to the second microphone signal by subtracting the signals corresponding to the third microphone from the first microphone to form a first difference signal, summing the signals corresponding to the fourth microphone from the second microphone to form a second difference signal, and comparing the first difference signal to the second difference signal and determining whether one may have a greater noise content than the other.

Advantages include improving both far-field sound detection for conversation assistance and near-field sound detection for remote communication, in a single device. Rejection of wind noise is also improved.

All examples and features mentioned above can be combined in any technically possible way. Other features and advantages will be apparent from the description and the claims.

DESCRIPTION

Figure 1:
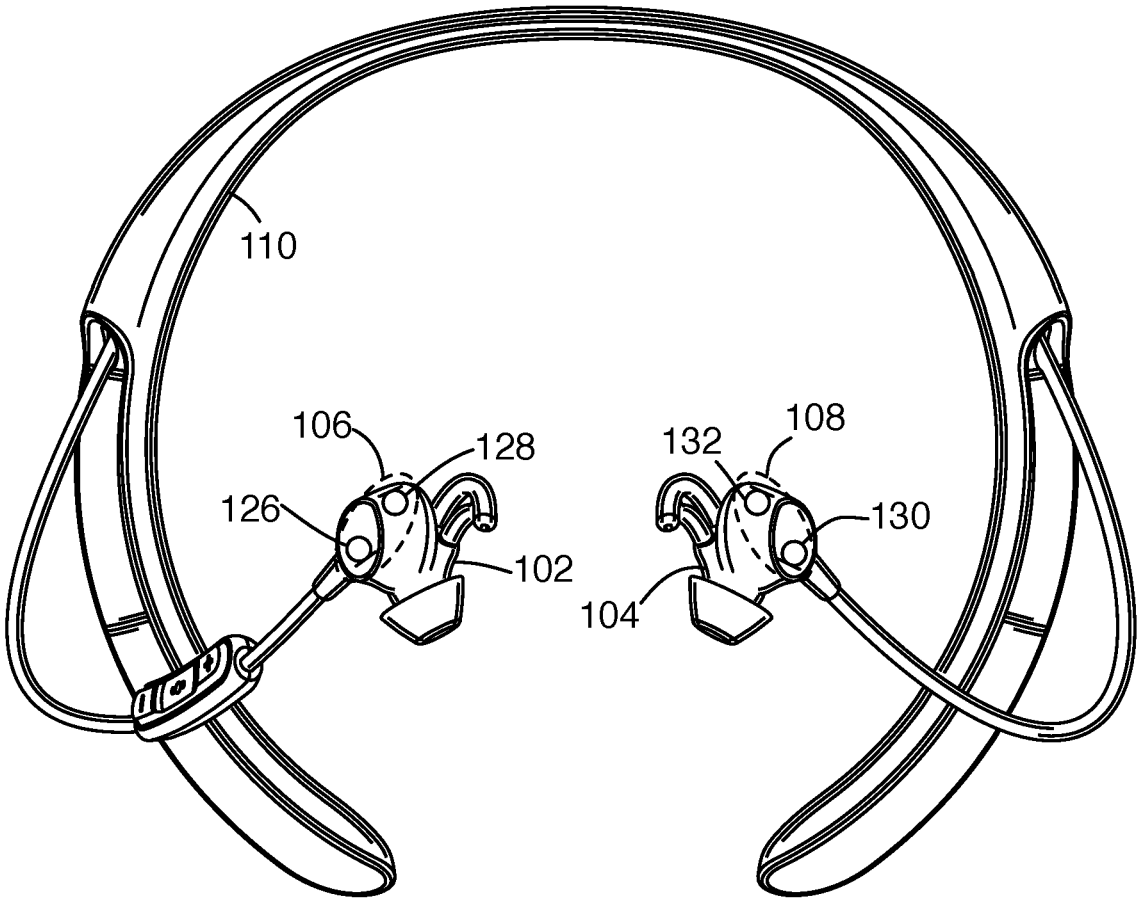
FIG. 1 shows a set of headphones.
Figure 2:
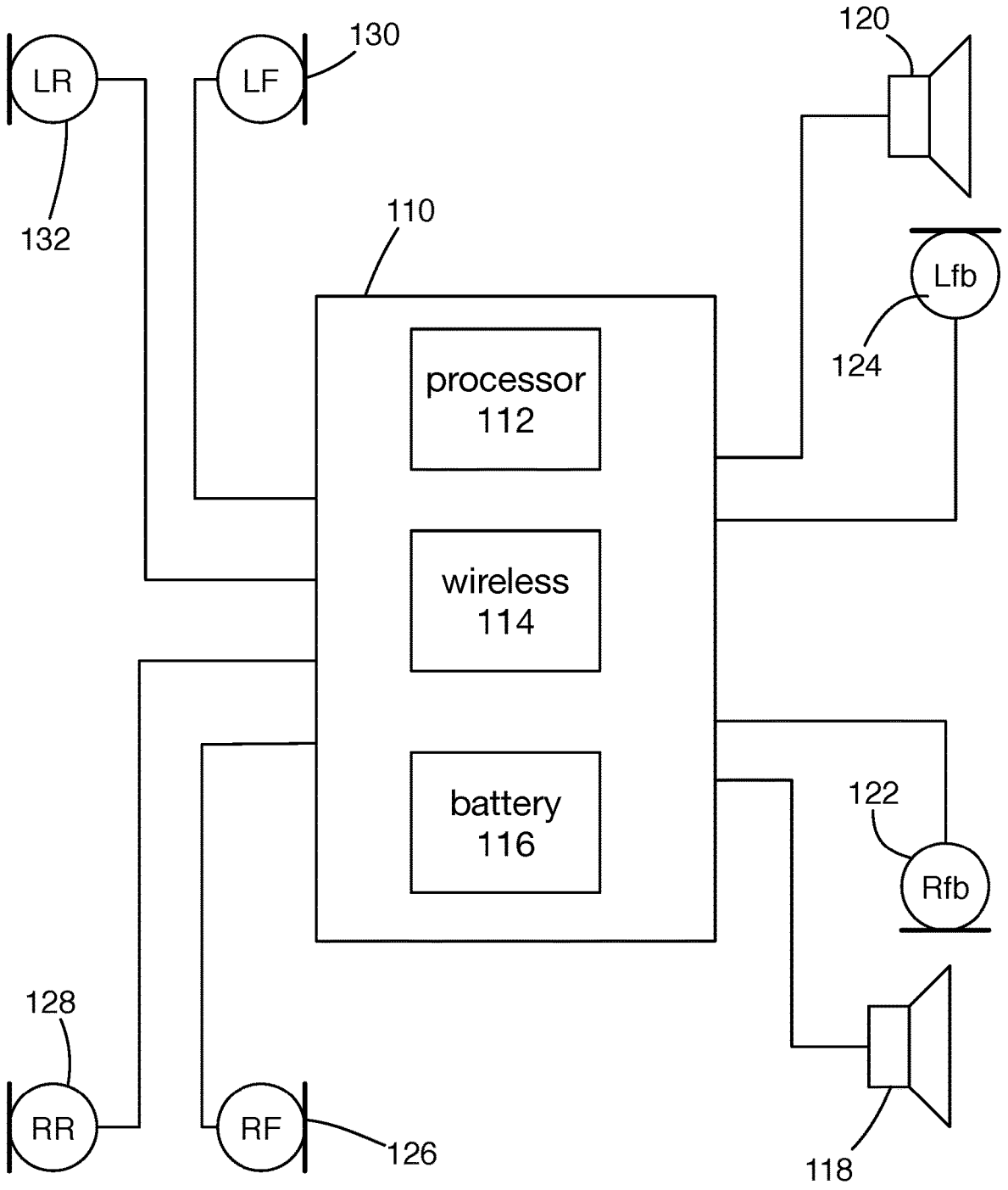
FIGS. 2 through 10 show schematic block diagrams.

In a new headphone architecture shown in FIG. 1, two earphones 102, 104 each contain a two-microphone array, 106 and 108. The two earphones 102, 104 are connected to a central unit 110, worn around the user's neck. As shown schematically in FIG. 2, the central unit includes a processor 112, wireless communications system 114, and battery 116. The earphones also each contain a speaker, 118, 120, and additional microphones 122, 124 used for providing feedback-based active noise reduction. The microphones in the two arrays 106 and 108 are labelled as 126, 128, 130, and 132. These microphones serve multiple purposes: their output signals are used as ambient sound to be cancelled in feed-forward noise cancellation, as ambient sound (including the voice of a local conversation partner) to be enhanced for conversation assistance, as voice sounds to be transmitted to a remote conversation partner through the wireless communications system, and as side-tone voice sounds to play back for the user to hear his own voice while speaking. In the example of FIG. 1, the four microphones are arranged with the front microphone on each ear pointing forward, and the rear microphone on each ear pointing rearward. A line through each pair of microphones points generally forward when the headphone is worn by a typical user, to optimize detection of sound from the direction where the user is looking. The earphones are arranged to point their respective pairs of microphones slightly inward when worn, so the lines through the microphone arrays converge a meter or two ahead of user. This has the particular benefit of optimizing the reception of the voice of someone facing the user.

Figure 3:
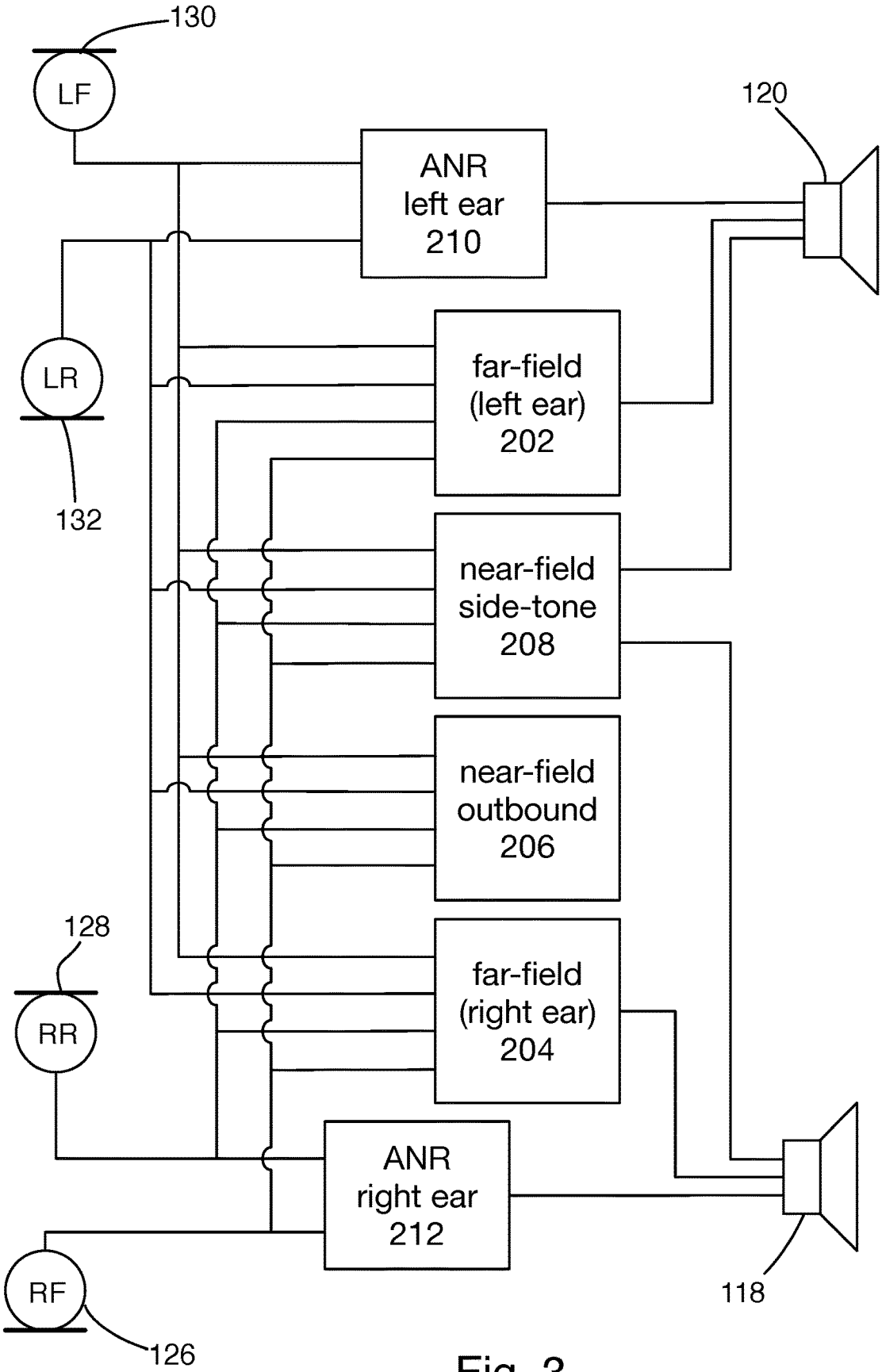

The processor 112 applies a number of configurable filters to the signals from the various microphones. The provision of a high-bandwidth communication channel from all four microphones 126, 128, 130, 132, two located at each ear, to a shared processing system provides new opportunities in both local conversation assistance and communication with a remote person or system. Specifically, as shown in FIG. 3, a first set of filters 202 is used to make the best use of the microphones' physical arrangement, and combine the four microphone signals to form a far-field array optimized for detecting sound from a nearby source, such as a local conversation partner. When we say the array is optimized for detecting sounds from a nearby source, we mean that the sensitivity of the array to signals originating front in front of the headphone wearer at a distance of about one to two meters is greater than the sensitivity to sounds originating closer to or farther from the headphones, or from other directions. The use of all four microphones together, as described in U.S. Patent application publication 2015/0230026, can lead to improved performance over using a separate pair of microphones for each ear. In addition, the arrays can be configured differently for the two ears, for example, to preserve binaural spatial perception, by using two separate sets of filters, 202 and 204.

A third set of filters 206 is used to combine the four microphone signals to form a near-field array optimized for detecting the user's own voice. When we say the array is optimized for detecting the user's own voice, we mean that the sensitivity of the array to signals originating from the user's mouth is greater than the sensitivity to sounds originating farther from the headphones. Even with the microphones 126, 128, 130, 132 physically arranged to optimize far-field pickup in front of the user, the combination of all four microphones has been found to provide near-field voice performance at least as good as, and in some cases better than, a two-microphone array in the same earbud location but physically aimed at the user's mouth.

In some examples, yet another set of filters 208 is used for providing the user's voice back to the user himself, commonly called side-tone. The side-tone voice signal may be filtered differently from the outbound voice signal to account for the effect of the earphone's acoustics on the user's perception of his or her own voice. Finally, active noise reduction (ANR) filters 210, 212 for each ear use at least one of the local microphones to produce noise-cancelling signals. The ANR filters may use one or both external microphones and the feedback microphone for each ear to cancel ambient noise. In some examples, the external microphones from the opposite ear may also be used for ANR in each ear.

Figure 4:
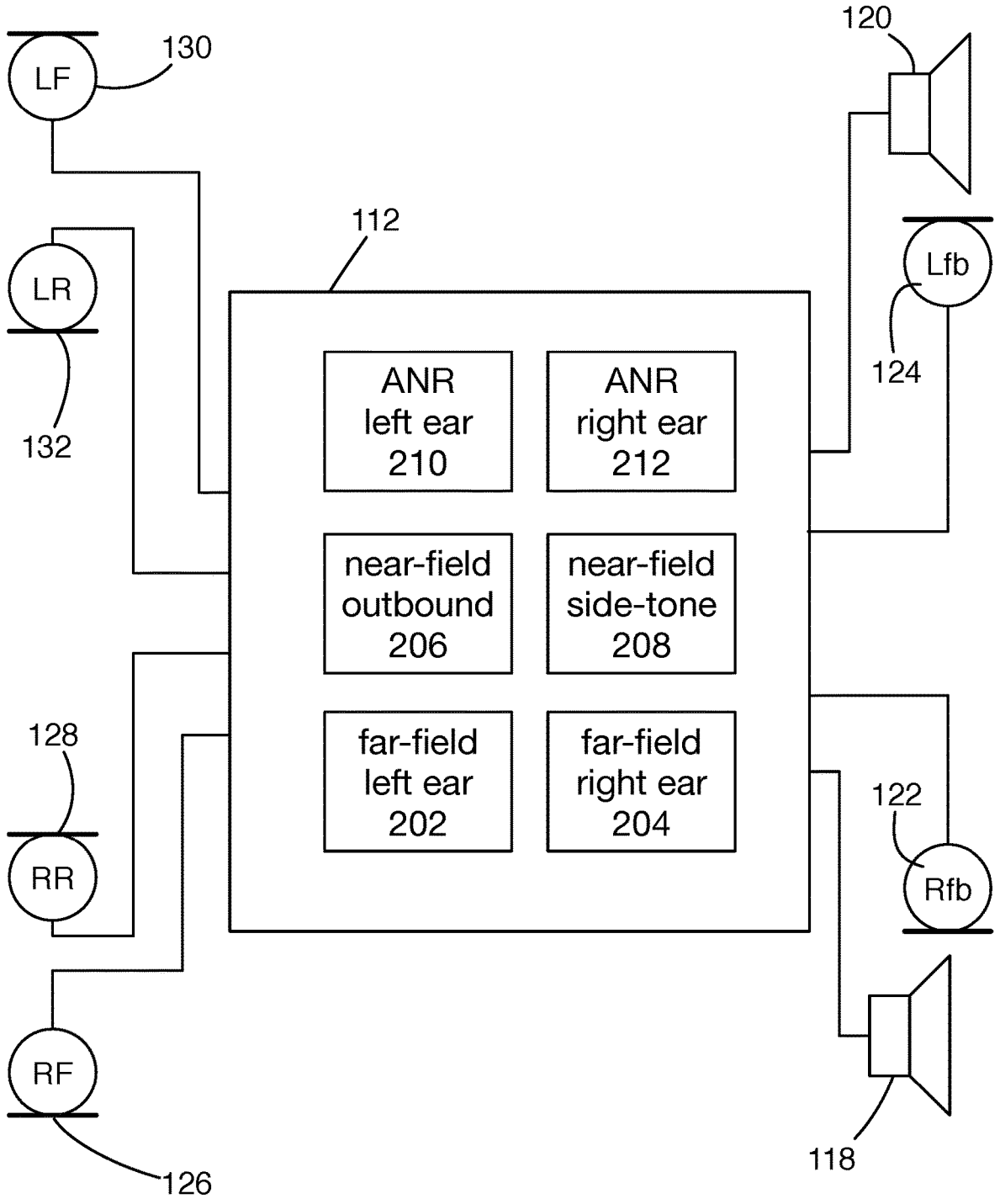

The ANR signals, far-field array signals, side-tone signals, and any incoming communication or entertainment signals (not shown) are summed for each ear. As shown in FIG. 4, at least some of the filters are implemented in the processor 112, with the processor handling the distribution of the four microphone signals (plus the feedback microphone signals) to the various filters. Likewise, the processor may handle the summation of the multiple filter outputs and their distribution to the appropriate speakers.

Figure 5:
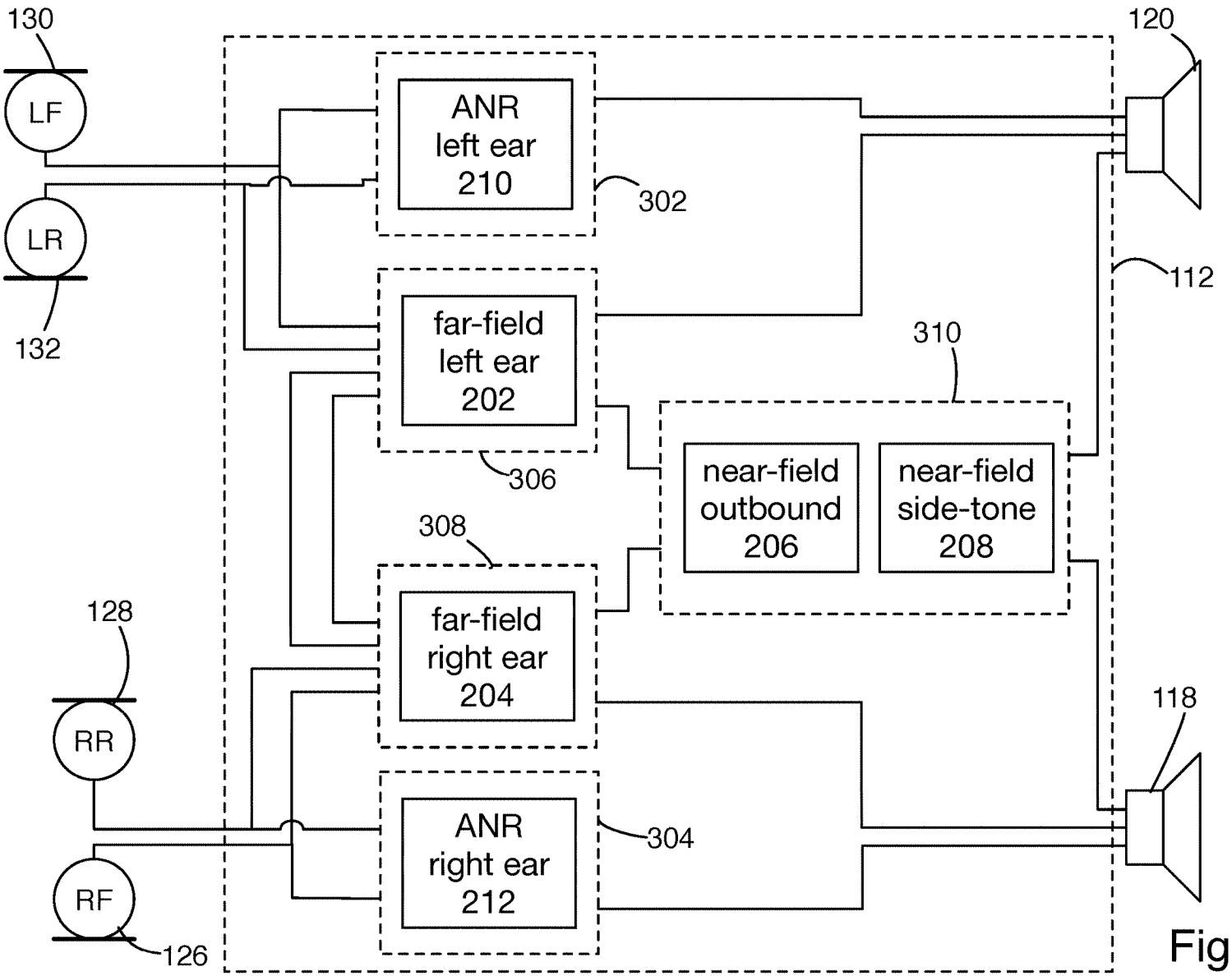

In some examples, as shown in FIG. 5, the processor 112 is provided by a combination of separate dedicated sub-processors, such as left and right ANR processors 302, 304, left and right array processors 306, 308, and communications processor 310. An example of a suitable ANR processor is described in U.S. Pat. No. 8,184,822, the entire contents of which are incorporated here by reference. A similar processor may be used for the array processing. An example of a suitable communications processor is the CSR8670 from Qualcomm Inc., which in some examples also provides general-purpose processing control of the ANR and array processors, as well as providing the wireless communication system 114. In other examples, a single ANR or array processor may handle both sides, or the communication processor may also have separate left- and right-side processors. The ANR and array filters may be provided a single processor per side, or all filtering may be handled by a single processor. The four external microphone signals may each be provided directly to each of the sub-processors, or one or more of the sub-processors, such as the array processors, may receive a subset of the microphone signals directly and transfer those signals over a bus to the other processors (as shown in FIG. 5).

Far-Field Filtering

Figure 6:
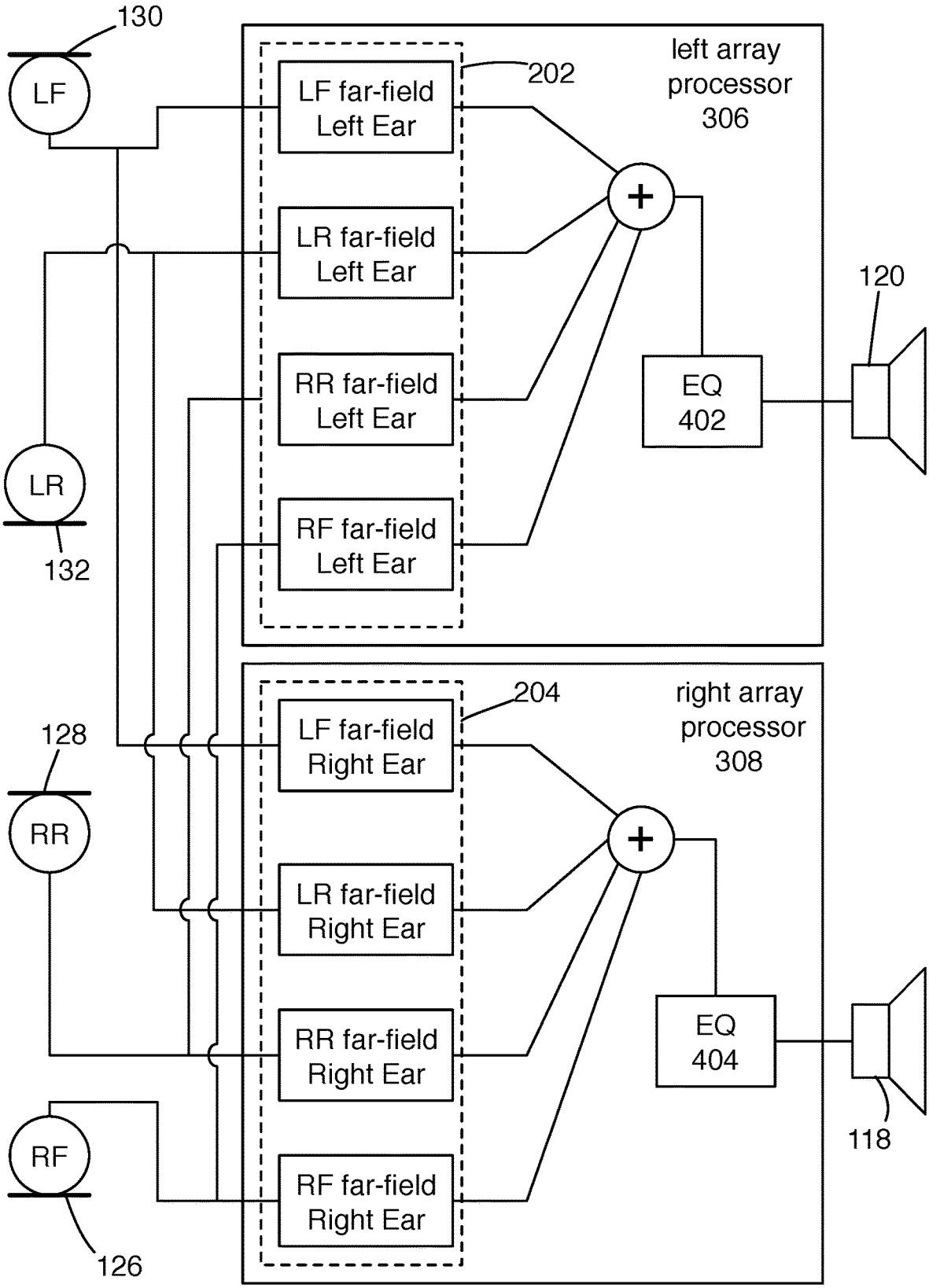

An example topology for far-field microphone processing is shown in FIG. 6. This represents a sub-set of the processing carried out by the complete product represented in the preceding figures. In this example, each of the four microphone signals LF, LR, RF, and RR is provided to each of two array processors 306, 308. If the same far-field signal is to be provided to each ear, only a single such processor is needed. Each array processor applies a specific filter to each incoming microphone signal before summing the filtered signals to produce a far-field signal for the respective ear. The summed signals are in turn equalized 402, 404, based on the specific filters applied to each individual microphone signal.

The particular filters and related signal processing for generating the far-field signals for output to the left and right ear are described in application U.S. 2015/0230026, incorporated by reference above. All of the filtering, summing, equalizing, and processing shown in FIG. 6 could be performed in a single processor, or a different combination of processors than that used in the example. In some examples, rather than being directly output to the speakers, the array processor outputs are provided as signal inputs to the ANR processors, to provide a directional component to a hear-through feature of the ANR system, such as that described in U.S. Pat. No. 8,798,283, the contents of which are incorporated here by reference.

Near-Field Communication Filters

Figure 7:
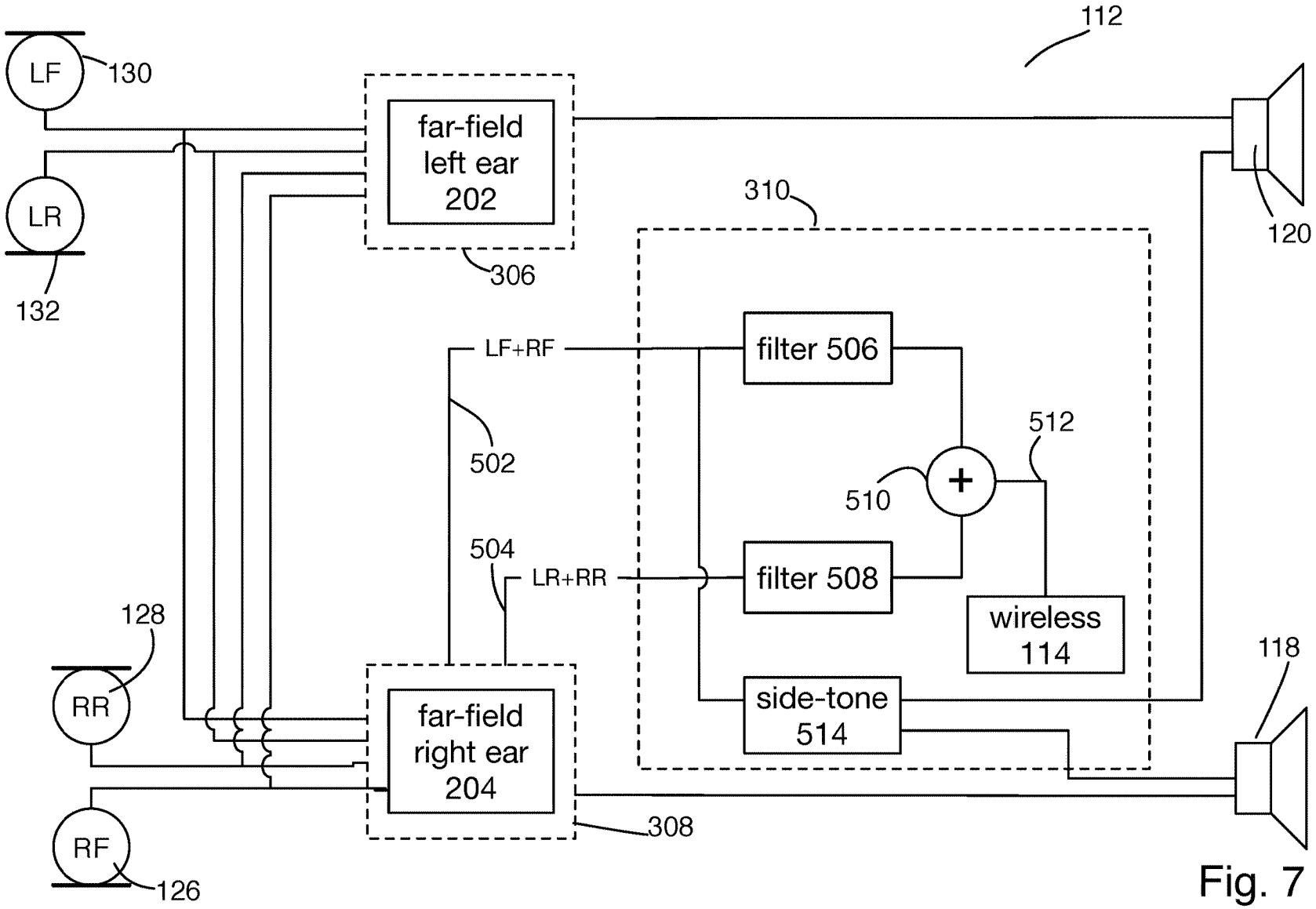

As noted above, even with the four microphones physically arranged to optimize far-field voice pickup, when all four are combined, they also produce good near-field voice signals for communication purposes. Previous communication headsets have combined two microphones to improve detection of the user's voice, for example, in a beam-forming array aimed at the user's mouth. To a high level, the same type of processing shown in FIG. 6 can be performed to generate a near-field signal, using appropriately different filter coefficients. As compared to FIG. 6, only one set of filters would be needed to generate an outbound voice signal. In some examples, as shown in FIG. 7, one of the array processors 306 or 308 combines the four microphone signals before providing two composite signals to the communications processor 310, which implements the near-field voice filtering. Specifically, the array processor 308 sums the two front microphone signals LF and RF and the two rear microphone signals LR and RR, and provides the two sets of summed signals 502, 504 to the communications processor 310. The communications processor combines the two sets of summed signals to form a near-field array signal that optimizes the user's own voice relative to far-field energy. The front sum and the rear sum are each filtered 506, 508, and the two filtered sums are then combined 510 to generate the near-field array signal 512. This simplifies the design of the communication processor 310 and signal routing between the processors, by providing only two inbound signals to the communication processor. In the particular example of FIG. 7, the wireless communication system 114 is integrated with the communication processor 310 and the near-field signal is provided directly to the outbound communication link. With a more powerful communication processor, the pre-summing may not be needed, and all four microphone signals may be individually filtered to further optimize pickup of the user's voice.

Side-Tone Filters

In headsets that block the user's ear, hearing their own voice played back can help the user control the level at which they speak, and feel more comfortable talking into the headset. As anyone who has listened to a recording of themselves can relate, however, simply providing the outbound communication signal to the user's ear may not sound natural. This is even more pronounced due to the way the earphones 102, 104 change how the user perceives their own voice. U.S. Pat. No. 9,020,160, incorporated here by reference, discusses ways of filtering feedback and feed-forward microphone signals to produce a self-voice signal that sounds more natural. These techniques can be used in the present architecture either using all four microphones, as shown by filter 208 in FIG. 3, or using the pre-summed front microphone signals from the outbound signal processing steps, as shown by filter 514 in FIG. 7. In some examples, the self-voice filtering is done as part of the ANR filtering. This can be particularly advantageous because unmodified feedback-based noise reduction can alleviate a large part of the occlusion effect that amplifies the lower-frequency components of one's voice when wearing headphones. The external microphone signals are then used to re-inject the higher-frequency components of the voice that are lost when the ears are blocked (rather than cancelling them as ambient noise). The cancellation of the occlusion effect may be handled by the ANR processors 302, 304, while the communication processor 310 provides the side-tone signal from the external microphones.

In a simplified example, such as in the example of FIG. 7, the summed front microphone signals from the communications pathway are simply low-pass-filtered and equalized to provide a basic side-tone signal. The side-tone signal is then summed with the other local output signals and provided to the speakers 118, 120

Wind-Noise Mitigation

Figure 8:
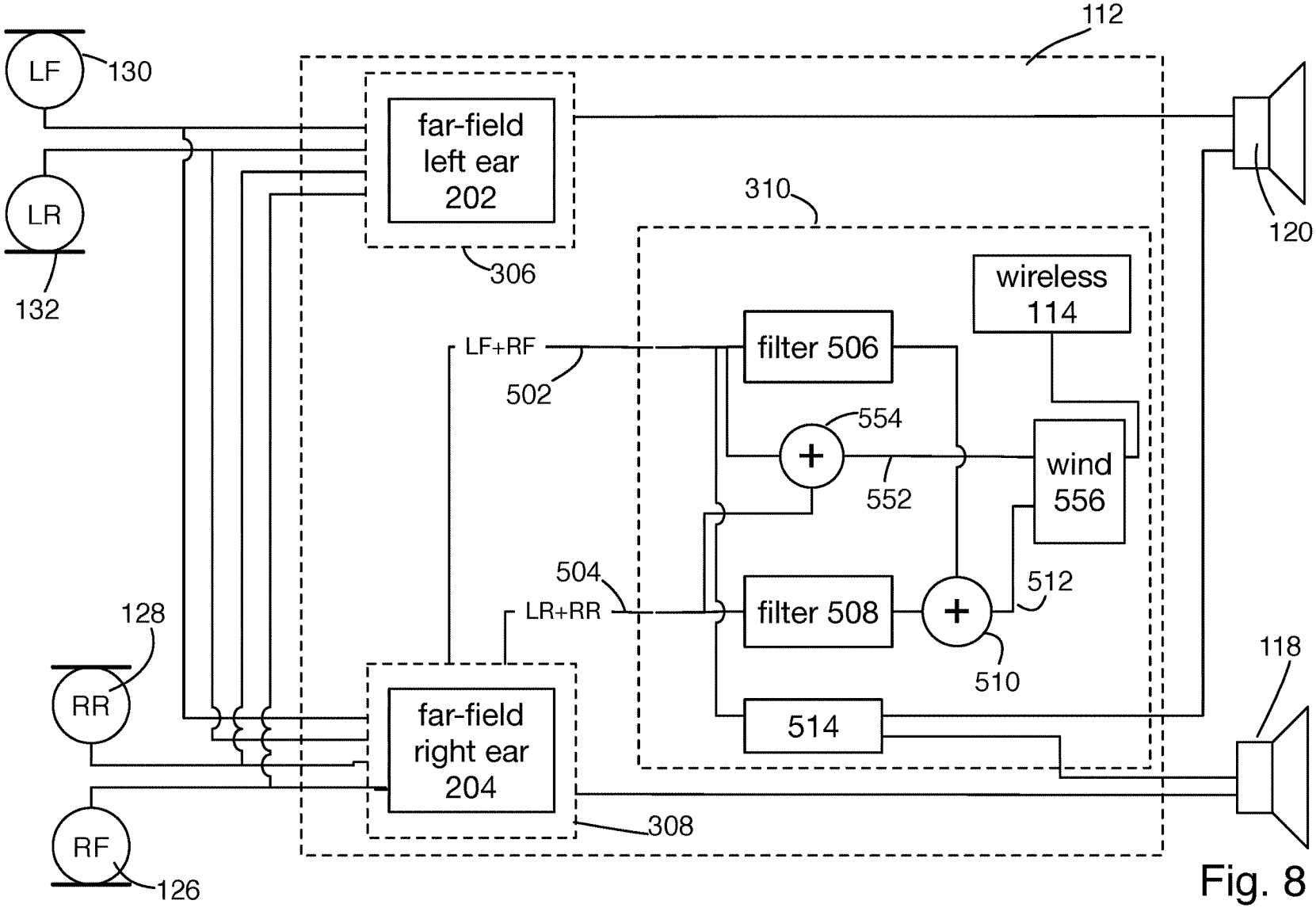

As noted above, two microphones have previously been used as beam-forming arrays to detect the user's voice. In other examples, as described in U.S. Pat. No. 8,620,650, incorporated here by reference, two microphone signals can be combined to optimize rejection of ambient and wind noise. This can be adapted to the example of FIG. 7, as shown in FIG. 8, to remove wind noise from the near-field array. The term 'wind noise' is used here to describe noise caused by air flow directly striking the earphones, as opposed to 'ambient' noise, which refers to acoustic noise arriving at the earphones from other sources (which could include distant wind). The method of the '650 patent is used with one microphone signal that is sensitive to wind noise, and one that is less sensitive to wind noise but more sensitive to ambient noise. A weighted sum is used, where the weight given to each signal depends on the relative amount of noise energy present in each signal. In the particular example of FIG. 8, the array signal 512 tends to be sensitive to wind noise. A wind-noise optimizer 556 in the manner of the '650 patent combines the array signal 512 with an omnidirectional signal 552, formed by summing (554) the incoming front sum 502 and rear sum 504. This produces an improved output signal for use as the outbound voice signal. In the particular example of FIG. 8, the processing is done in the communications processor 310, which integrates the wireless communication system 114.

Figure 9:
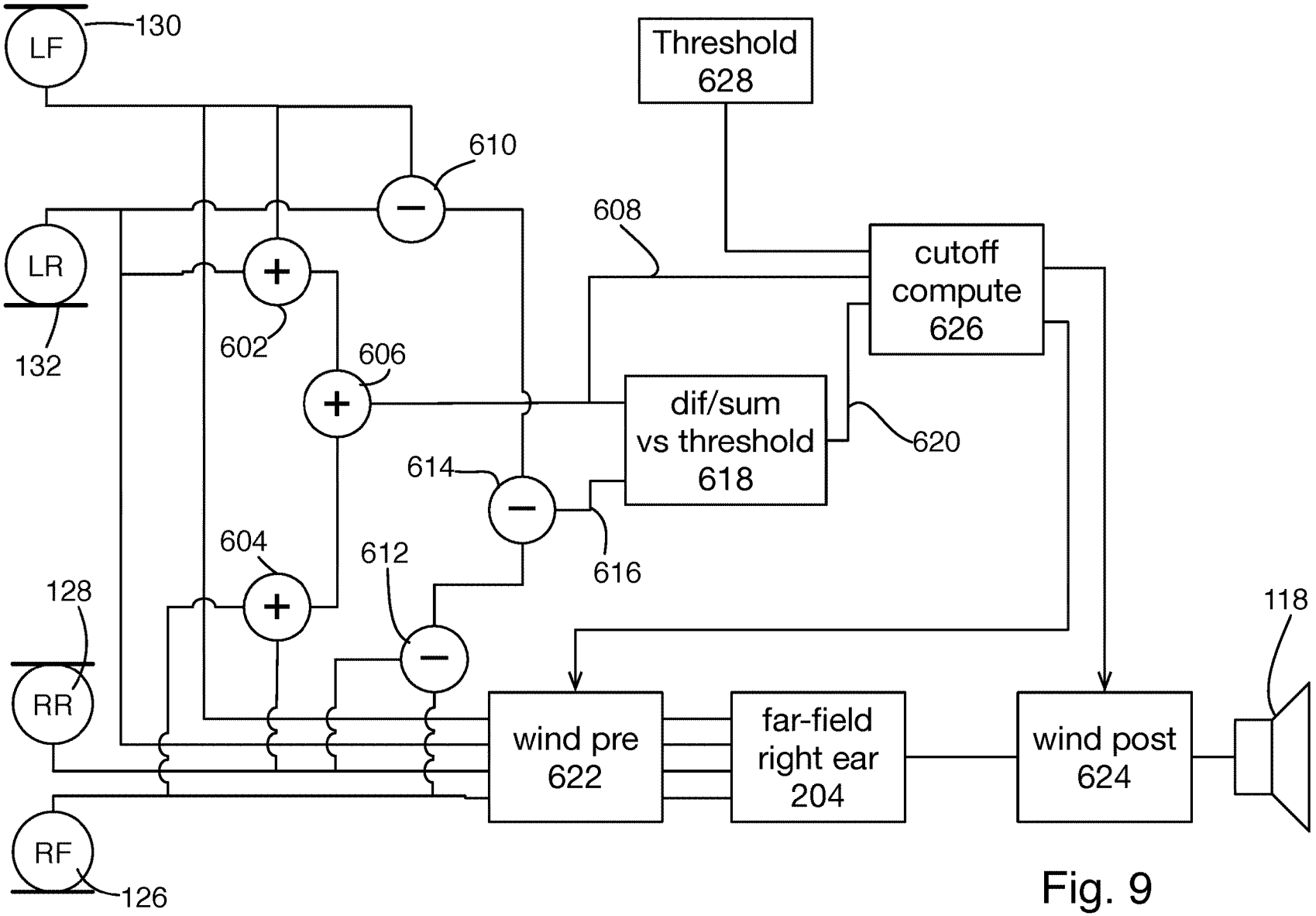

The far-field array signal is also susceptible to wind noise, but different processing is used to manage it. In some examples, as shown in FIG. 9, the processing fades between an omnidirectional mode at low frequencies and the directional far-field array mode at higher frequencies based on the presence of wind noise in the signal. In this example, the four microphone signals are summed, 602, 604, 606, to produce a total energy signal 608. At the same time, a difference (LF−LB) 610 of the two left microphones is computed, a difference (RF−RB) 612 of the two right microphones is computed, and the difference ((LF−LB)−(RF−RB)) 614 of those two differences is computed. The ratio of that final difference signal 616 to the total energy signal 608 is compared 618 to a threshold to produce a wind indicator signal 620. The wind signal 620 serves as an input, along with the total energy signal 608, to a computation 626 that determines a cutoff frequency for two additional sets of filters 622, 624. The wind pre-filters 622 filter the individual microphone signals. In particular, the wind pre-filters apply all-pass filters that invert the phase of the front microphone signals below the computed cutoff frequency. This causes the array to have omnidirectional sensitivity at lower frequencies, and to maintain directivity at higher frequencies. As the wind level increases, the cutoff frequency below which the front microphones are inverted is raised, fading in increasing omnidirectional behavior—at high wind levels, the directional array is not particularly useful anyway, so the entire bandwidth is made omnidirectional.

A second set of wind filters 624 is applied after the far-field array processing 204. This second set of wind filters does two things: it decreases low-frequency gain, and it applies a high-pass filter. In the normal far-field array processing, high gain is applied at lower frequencies to account for the loss of energy due to the directionality of the array. As the sensitivity at lower frequencies is shifted to being omnidirectional, this energy is restored and the gain can be reduced. The cutoff frequency of this low-frequency gain is based on the cutoff frequency of the all-pass filters 622, but may not be exactly the same frequency. At the same time, the high-pass filter removes whatever residual wind noise is still picked up—at particularly high wind levels, this may be more effective than the other techniques. As the wind level increases, both the low-frequency gain cutoff frequency and the high-pass filter cutoff frequency are raised, following the raising inversion frequency of the wind pre-filters. FIG. 9 shows the processing for only the right ear. The same processing is performed for the left ear, and is omitted for clarity. In some examples, the same control signal 620 and cutoff frequencies are used for both ears, and they may be computed once for the whole system, or redundantly in the separate array processors.

Mitigation of White Noise Gain at Low Frequencies

In some examples, also shown in FIG. 9, an additional use is made of the wind filters 622 and 624. When the directional far-field array is used, the effective noise floor at low frequencies is elevated, due to the increased gain needed to make up for loss of energy in the array. This is noticeable to the user when in a quiet environment, but in such an environment, the far-field array is of less benefit than it is in noisy environments. Therefore, the wind noise pre-filter 622 can be used to fade to omnidirectional sensitivity at low frequencies when ambient noise is low, even when wind noise is also low and it would otherwise favor the directional signal. A threshold 628 provides an additional input to the cutoff computation 626, and if the wind detection 620 is low, but the total energy 608 is also below the threshold 628, then the wind pre-filters 622 are still applied. This reduces white-noise gain at low frequencies. The low frequency gain is also restored in this situation by wind filter 624, but the high-pass filter is not used. The cutoff frequency calculated in the low-noise situation may follow a different functional relationship to the total energy signal 608 than in the high wind situation.

Bilateral Wind Mitigation

Figure 10:
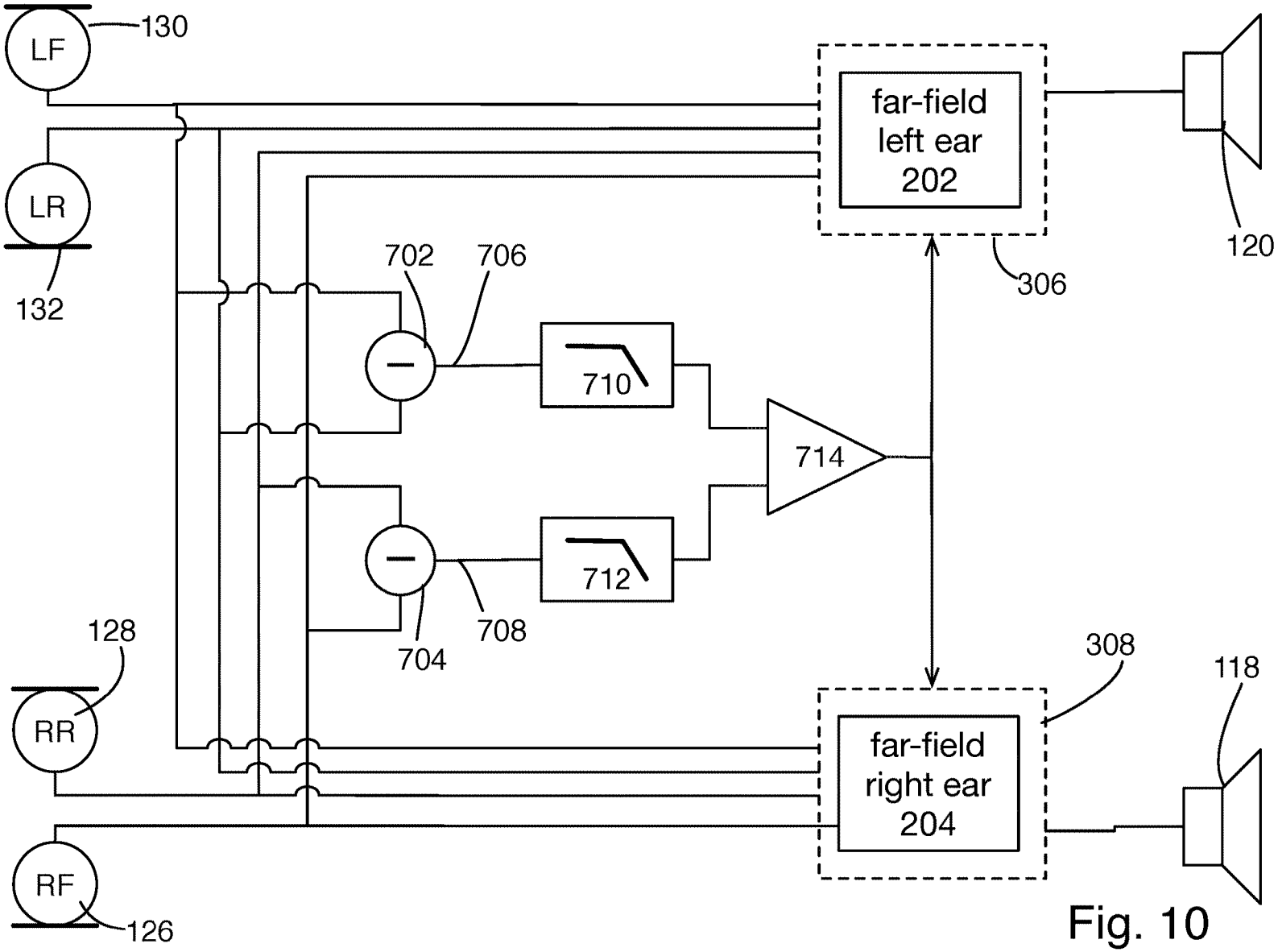

Rather than combining the left and right microphone signals, as mentioned above in the discussion of near-field voice pickup, the wind-vs-ambient noise mixing algorithm used for the near-field signal can also be adapted to use separate left and right microphone signals to optimize rejection of noise that is asymmetric in the far-field microphone signal, e.g., if wind is striking the user from one side more than the other. In this example, as shown in FIG. 10, the rear microphones are subtracted 702, 704 from the front microphones on each side to produce left and right difference signals 706, 708. These signals are not the same due to shading of the head between the two earpieces. The difference signals are then each low-pass filtered 710, 712 and compared 714 to determine if one side is subject to more wind than the other. If so, the microphone signals from the noisy side are suppressed at low frequencies, where the wind is most problematic by decreasing the gain applied to the microphones from that side at low frequencies by the far-field filters. Alternatively, a pre-filter stage could reduce that gain, similarly to the symmetric wind control method shown in FIG. 9. The system slowly fades back to using all four microphones, and if the wind has died down, this fading continues until full use of all the microphones is restored at all frequencies. If wind is again detected, the system quickly fades back to one-sided operation at low frequencies.

The summing and comparison can be done in each of the array processors (assuming there are two, as in some of the examples), or done in one of them and a control signal provided to the other. If the communication processer were provided with all four microphone signals, rather than with the pre-summed front and rear signal pairs, then a similar left/right wind noise control could be applied to the near-end voice signal in combination with the omnidirectional/directional wind noise control shown in FIG. 7. Alternatively, in the example of FIG. 7, the array processors could decrease the weighting of the left or right microphones in the front/rear sums provided to the communication processor. This approach is also useful with only one microphone per ear, as the total energy on each side can be compared to determine if a noise source is asymmetric, and the signals balanced in the same manner.

Simultaneous Operation

With sufficient processing power, the different sets of filters can be used in parallel to simultaneously produce the near-field and far-field signals. This allows the user to his own voice and a conversation partner's voice simultaneously (i.e., if they are talking over each other), or to talk on the wireless connection at the same time as listening to another person. Aside from simply multitasking, that latter can be useful if more than one person in a conversation is using a device such as the one described herein. See, for example, U.S. Pat. No. 9,190,043, the entire contents of which are incorporated here by reference. Each of the multiple headsets can transmit its user's locally-detected voice, from the near-field filters, to the other headsets, where it can be combined with the results of that headset's far-field filters to provide the user with a complete set of their conversation partner(s) voices.

The simultaneous detection of near-field and far-field voice can also be useful where the near-field is not being used for conversation. For example, if the headset implements or is connected to a voice personal assistant (VPA, the near-field signal can be directed to that system, or to a wake-up word detection process. The near-field signal should provide a higher signal-to-noise ratio for this than simply using ambient microphones.

The near-field and far-field signals can also be compared to each other. One result of this comparison could be to estimate the proximity of the dominant signal—if the correlation of the two is high, it is the user speaking. This can be used for a voice activity detector, or to change other noise reduction algorithms, to name two examples.

In the particular example of FIG. 1, the earphones are connected to the central unit by wires that communicate signals between the microphones and speakers in the earphones and the various processors in the central unit. In other examples, the processing, communications, and battery components are embedded in the earphones, which may be connected to each other by wired or wireless connections. Components and tasks may be split between the earphones, or repeated in both, depending on the architecture and the communication bandwidth. An important consideration of the present disclosure is that the signals from all four microphones, two per ear, are available to at least some of the processors that are generating sound for playback at each ear, and all four signals are ultimately provided to the processor generating signals for transmission over the communication system, though there may be intermediate summing steps for the communication path.

Embodiments of the systems and methods described above comprise computer components and computer-implemented steps that will be apparent to those skilled in the art. For example, it should be understood by one of skill in the art that the computer-implemented steps may be stored as computer-executable instructions on a computer-readable medium such as, for example, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

A number of implementations have been described. Nevertheless, it will be understood that additional modifications may be made without departing from the scope of the inventive concepts described herein, and, accordingly, other embodiments are within the scope of the following claims.

What is claimed is:

1. An apparatus comprising:

a first earphone having a first microphone array, providing a first set of microphone signals, and a first speaker;

a second earphone having a second microphone array, providing a second set of microphone signals, and a second speaker; and a processor receiving the first set of microphone signals and second set of microphone signals, and configured to:

apply a first set of filters to combine the first and second sets of microphone signals to generate a first signal that is more sensitive to sounds originating at a first location relative to the apparatus than to sounds originating at a second location relative to the apparatus;

provide the first signal to a first output;

apply a second set of filters to combine the first and second sets of microphone signals to generate a second signal that is more sensitive to sounds from the second location relative to the apparatus than to sounds originating at the first location relative to the apparatus; and provide the second signal to a second output.

2. The apparatus of claim 1, wherein the first microphone array and second microphone array are physically arranged to optimize detection of sounds a short distance away from the apparatus.

3. The apparatus of claim 1, wherein the processor is further configured to:

use a third set of filters, different from the second set of filters, to combine the microphone signals to generate a third signal that is more sensitive to sounds from the second location relative to the apparatus than to sounds originating at the first location relative to the apparatus; and provide the third signal to a third output.

4. The apparatus of claim 1, wherein applying the first set of filters comprises:

applying separate filters to each signal from each of the first and second sets of microphone signals to produce a first set of filtered signals;

summing the signals of the first set of filtered signals to produce a first summed signal; and applying an equalization filter to the first summed signal to generate the first signal.

5. The apparatus of claim 1, wherein the processor is further configured to generate the first signal and provide the first signal to the first output by:

combining the microphone signals, using a third set of filters, different from the first set of filters, to generate a third signal that is more sensitive to sounds originating at the first location relative to the apparatus than to sounds originating at the second location relative to the apparatus;

providing the first signal to a first channel of the first output; and providing the third signal to a second channel of the first output.

6. The apparatus of claim 1, wherein the processor comprises a first array sub-processor for applying the first set of filters, and a second array sub-processor for applying the second set of filters, and wherein the sub-processors are configured to generate the first signal by:

in the first array sub-processor, summing signals corresponding to a first one of the microphones in the first array and a first one of the microphones in the second array to form a combined front microphone signal, and summing signals corresponding to a second one of the microphones in the first array and a second one of the microphones in the second array to form a combined rear microphone signal; and in the second array sub-processor, filtering the combined front microphone signal to form a filtered combined front microphone signal, filtering the combined rear microphone signal to form a filtered combined rear microphone signal, and combining the filtered combined front microphone signal and the filtered combined rear microphone signal to form a directional microphone signal;

the second signal comprising the directional microphone signal.

7. The apparatus of claim 1, wherein the processor is further configured to operate the first and second sets of filters simultaneously.

8. The apparatus of claim 1, wherein:

the first signal is more sensitive to sounds originating in a first direction than to sounds originating in other directions, and the processor is further configured to:

apply a third set of filters to combine at least the first set of microphone signals to generate a first anti-noise signal that will cancel sounds at the first earphone when output by the first speaker; and apply a fourth set of filters to combine at least the second set of microphone signals to generate a second anti-noise signal that will cancel sounds at the second earphone when output by the second speaker.

9. A method comprising, in a processor:

receiving, from a first earphone having a first microphone array, a first set of microphone signals;

receiving, from a second earphone having a second microphone array, a second set of microphone signals; and combining the first and second sets of microphone signals, using a first set of filters, to generate a first signal that is more sensitive to sounds originating at a first location relative to the first and second earphones than to sounds originating at a second location relative to the first and second earphones;

providing the first signal to a first output;

combining the first and second sets of microphone signals, using a second set of filters, to generate a second signal that is more sensitive to sounds originating at the second location relative to the first and second earphones than to sounds originating at the first location relative to the first and second earphones; and providing the second signal to a second output.

10. The method of claim 9, further comprising, in the processor:

combining the microphone signals using a third set of filters, different from the second set of filters, to generate a third signal that is more sensitive to sounds from the second location relative to the first and second earphones than to sounds originating at the first location relative to the first and second earphones; and providing the third signal to a third output.

11. The method of claim 9, wherein applying the first set of filters comprises:

applying separate filters to each signal from each of the first and second sets of microphone signals to produce a first set of filtered signals;

summing the signals of the first set of filtered signals to produce a first summed signal; and applying an equalization filter to the first summed signal to generate the first signal.

12. The method of claim 9, wherein generating the first signal and providing the first signal to the output comprises, in the processor:

using a third set of filters, different from the first set of filters, to combine the microphone signals to generate a third signal that is more sensitive to sounds originating at the first location relative to the first and second earphones than to sounds originating at the second location relative to the first and second earphones;

providing the first signal to a first channel of the first output; and providing the third signal to a second channel of the first output.

13. The method of claim 9, wherein generating the near-field signal comprises:

in a first array sub-processor, summing signals corresponding to a first one of the microphones in the first array and a first one of the microphones in the second array to form a combined front microphone signal, and summing signals corresponding to a second one of the microphones in the first array and a second one of the microphones in the second array to form a combined rear microphone signal; and in a second array sub-processor, filtering the combined front microphone signal to form a filtered combined front microphone signal, filtering the combined rear microphone signal to form a filtered combined rear microphone signal, and combining the filtered combined front microphone signal and the filtered combined rear microphone signal to form a directional microphone signal;

the second signal comprising the directional microphone signal.

14. The method of claim 9, further comprising operating the first and second sets of filters simultaneously.

15. The method of claim 9, wherein the first signal is more sensitive to sounds originating in a first direction than to sounds originating in other directions, and the method further comprises:

applying a third set of filters to combine at least the first set of microphone signals to generate a first anti-noise signal that will cancel sounds at the first earphone when output by a first speaker; and applying a fourth set of filters to combine at least the second set of microphone signals to generate a second anti-noise signal that will cancel sounds at the second earphone when output by a second speaker.

* * * * *